US006484892B1

(12) United States Patent
Gooner

(10) Patent No.: US 6,484,892 B1
(45) Date of Patent: Nov. 26, 2002

(54) DEVICE FOR STORING TOOLS

(76) Inventor: Randolph E. Gooner, RD #4 Box 591B, Georgetown, DE (US) 19947

( * ) Notice: Subject to any disclaimer, the term of this patent is extended or adjusted under 35 U.S.C. 154(b) by 0 days.

(21) Appl. No.: 09/483,663

(22) Filed: Jan. 14, 2000

Related U.S. Application Data

(63) Continuation-in-part of application No. 09/154,795, filed on Sep. 17, 1998, now abandoned.

(51) Int. Cl.[7] ..... A47F 7/00
(52) U.S. Cl. ..... 211/70.6; 248/117.2; 248/176.2
(58) Field of Search ..... 211/70.6, 60.1, 211/70.1, 104, 88.01, 106.01; 248/176.2, 117.2

(56) References Cited

U.S. PATENT DOCUMENTS

| | | | | | |
|---|---|---|---|---|---|
| 1,680,668 | A | * | 8/1928 | De Boer | 211/88.01 |
| 1,684,124 | A | * | 9/1928 | Burgess | 211/88.01 |
| 1,715,048 | A | * | 5/1929 | Townsend | 211/88.01 |
| 1,804,120 | A | | 5/1931 | Sengbusch | 211/69.5 |
| 2,805,777 | A | * | 9/1957 | Larson | 211/70.1 X |
| 3,179,255 | A | * | 4/1965 | De'Caccia | 211/70.6 |
| 3,407,939 | A | * | 10/1968 | Villar-Kely | 211/90.1 |
| 4,068,760 | A | * | 1/1978 | Johnson, Jr. | 211/70.6 X |
| 4,121,719 | A | | 10/1978 | Wilhelm | 211/69.5 |
| 4,239,195 | A | * | 12/1980 | Oltman et al. | 269/16 |
| 4,343,172 | A | * | 8/1982 | Nordlund | 211/70.1 X |
| 4,365,720 | A | * | 12/1982 | Kaneshiro | 211/60 T |
| 4,397,395 | A | * | 8/1983 | McKelvey | 211/60 T |
| 4,412,618 | A | * | 11/1983 | La Conte | 211/60.1 X |
| 4,446,972 | A | * | 5/1984 | Sussman | 211/60.1 X |
| 4,503,945 | A | | 3/1985 | Meyers et al. | 206/486 |
| 4,815,610 | A | | 3/1989 | Borick et al. | 211/59.1 |
| 4,890,734 | A | * | 1/1990 | Gach | 206/366 |
| 5,186,319 | A | * | 2/1993 | Ting | 206/45.14 |
| 5,494,087 | A | * | 2/1996 | Pitelka et al. | 141/375 |
| 5,498,242 | A | * | 3/1996 | Cooke | 604/192 |
| 5,499,711 | A | | 3/1996 | Kozark | 206/45.1 |
| 5,641,079 | A | * | 6/1997 | Schmidt | 211/70.6 |
| 5,850,917 | A | * | 12/1998 | Denton et al. | 206/366 |
| 5,876,009 | A | * | 3/1999 | Simoncioni, Jr. | 248/339 |
| 5,975,295 | A | * | 11/1999 | Diamond | 206/366 |
| 6,095,057 | A | * | 8/2000 | Corban | 108/42 |

* cited by examiner

*Primary Examiner*—Daniel P. Stodola
*Assistant Examiner*—Khoa Tran
(74) *Attorney, Agent, or Firm*—Huntley & Associates

(57) ABSTRACT

Tool storage device having an angled surface with apertures formed therein sized for receiving the drive ends of power tools.

7 Claims, 2 Drawing Sheets

DEVICE FOR STORING TOOLS

CROSS-REFERENCE TO RELATED APPLICATION

This is a Continuation-in-Part of application Ser. No. 09/154,795, filed Sep. 17, 1998, now abandoned.

BACKGROUND OF THE INVENTION

The present invention generally relates to devices for the storage of tools. More specifically, the present invention relates to devices for the storage of powered driving tools such as impact wrenches and impact drivers typically found in automobile repair garages, services stations, and in automobile or vehicle manufacturing and repair facilities.

Most garages or other repair facilities use air compressed or electric powered drivers to assist in manipulation of screws, bolts, nuts, lugs, and other types of fasteners. Such powered drivers typically include impact wrenches or impact drivers, which generally consist of a pistol grip handle with means for connecting the tool to electric or compressed air power, and a drive end. The drive end is typically a shaft which terminates at a rectilinear male drive end that is adapted for insertion into the female end of a socket or other means for manipulating a nut, bolt, lug, or other such fastener.

Prior tool storage systems do not accommodate powered driving tools of the type discussed above. Accordingly, these tools and others like them are typically stored wherever possible, resulting in a potentially disorganized garage or repair facility. In operations for the manufacture or repair of vehicles such as automobiles, efficiency is important, and the lack of an organized system for the storage of all tools can result in decreased efficiency and repetition of effort. Furthermore, such lack of organization can result in temporary loss of tools, or repetitive investment in tools that are difficult to find. Accordingly, a need exists for a means of organizing powered drive tools that complements existing tool storage means and that provides a means of organizing a vehicle manufacture or repair facility. Such a means of organization can increase the efficiency of the facility and contribute to more economical and less time consuming operations.

SUMMARY OF THE INVENTION

The present invention provides a means of organizing and storing power driven tools that is compatible with existing tool storage devices such as chests and cabinets, and can also be used separately, providing a moveable means of storing power driven tools such as impact drivers and wrenches.

Specifically, the present invention provides a device for holding at least one power driven tool of the type comprising a handle and a substantially rectilinear male drive end at a terminal end thereof, the male drive end being adapted to be inserted into a substantially rectilinear female end of a component to be driven or manipulated by the tool;

the device comprising at least one aperture formed in a surface of the device, the aperture having an internal dimension substantially equal to the maximum dimension of the male drive end and having a cross-sectional configuration for retaining the male drive end in a fixed position, while the portion of the device posterior to the drive end is unsupported and cantilevered from the aperture, the surface in which the at least one aperture is formed being positioned at an acute angle with respect to a horizontal or a vertical plane;

a support and biasing bar on an inner surface of the device, the bar having apertures formed therein corresponding to the apertures formed in the surface of the device and aligned therewith; and means for separating the surface in which the at least one aperture is formed from a second surface by a distance at least equal to the length of the male drive end.

DETAILED DESCRIPTION OF THE INVENTION

The present invention will be more fully understood by reference to the drawings, which show representative embodiments of the present holding or storage devices. Variations and modifications of these embodiments can be substituted without departing from the principles of the invention, as will be evident to those skilled in the art.

Figure 1:
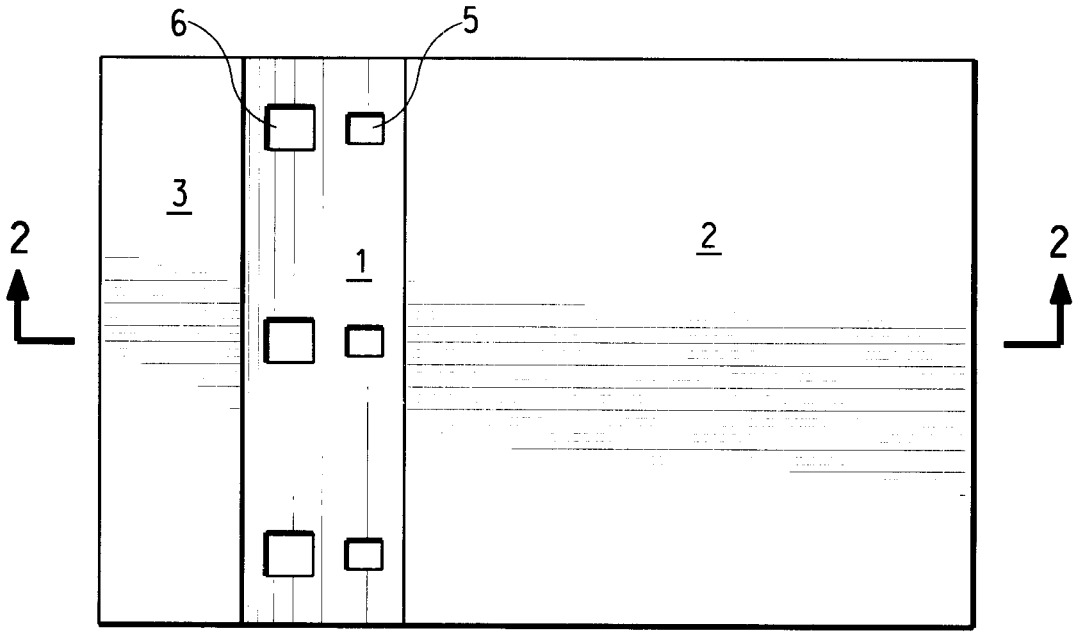
FIG. 1 is a top plan view of a device of the present invention.
Figure 2:
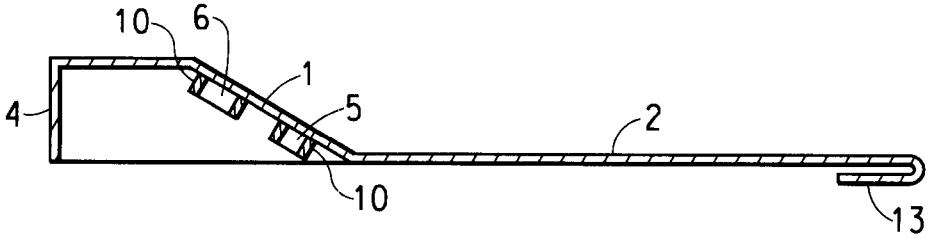
FIG. 2 is a cross-sectional view of a device of the present invention, taken at section 2—2 of FIG. 1.
Figure 3:
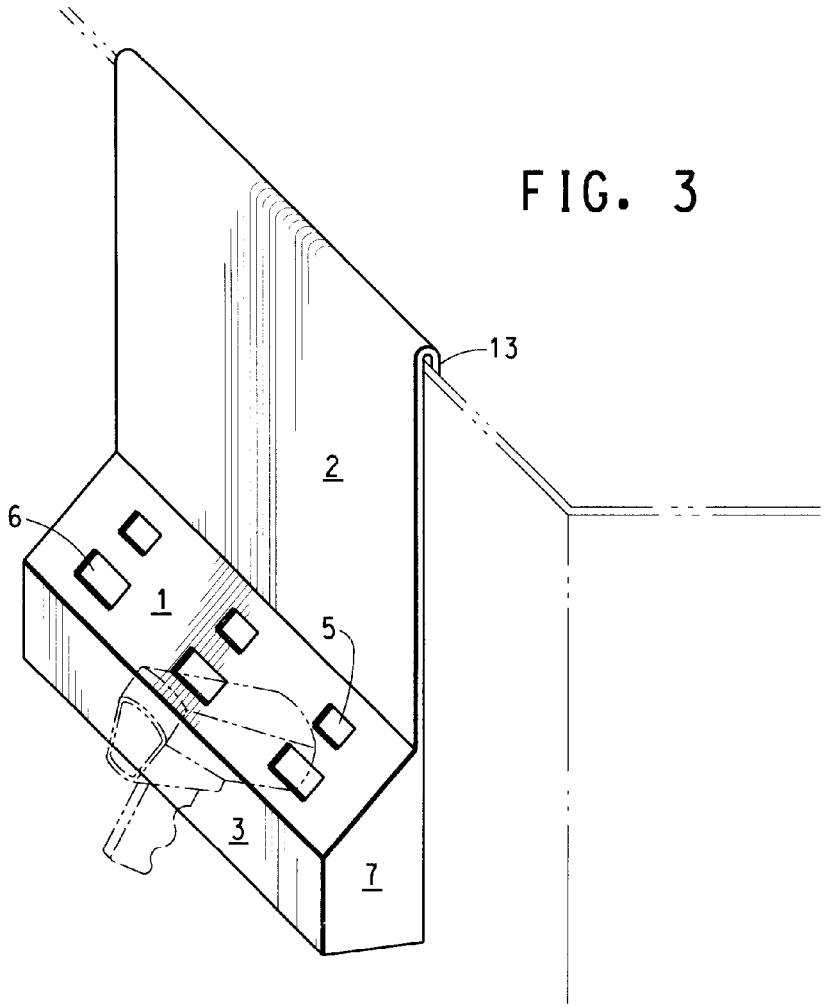
FIG. 3 is a perspective view of a device of the present invention hung on the side of a tool chest.

In FIGS. 1 and 2, a first planar surface 1 is joined to a second planar surface 2 in a fixed angular relationship. In this embodiment, the two surfaces are joined at an angle of about 135 degrees, although the angle can generally be about from 100 to 165 degrees, depending on the specific type of tool to be stored. The length of second planar surface 2 can vary widely, depending on the size and number of tools to be stored and the stability desired in the device. The second planar surface generally should be long enough to extend beyond the handles of the tools when resting in the device. While in the embodiment shown, this first planar surface is flat, this surface can also be provided in a curved configuration. As shown in this embodiment, third and fourth stabilizing surfaces 3 and 4 are also provided, forming a boxed enclosure that separates the female receiving means from the operating surface. The devices of the present invention preferably further comprise end caps, shown in FIG. 3 as element 7.

The materials used for the planar surfaces can vary widely. In general, metal sheet is used. Using stainless steel, 10–14 gauge has been found to be particularly satisfactory, providing a desirable balance of strength and formability. In the fabrication of the present devices, while two separate sheets of material can be joined together to form the first and second surfaces, it is more convenient to form these surfaces by bending a single sheet.

Figure 4A:
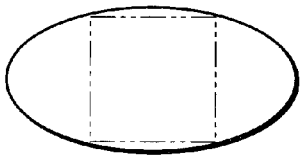
FIGS. 4*a*–4*c* are plan views of alternative configurations of the female receiving means of the present invention.
Figure 4B:
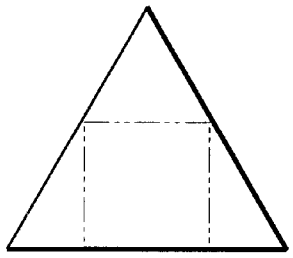
Figure 4C:
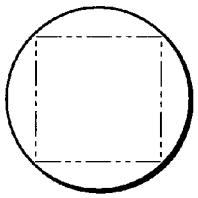

In the embodiment shown, three sets of female receiving means formed in the planar surface are illustrated, comprising smaller receiving means 5 and larger receiving means 6. In the embodiment shown, the smaller female receiving means 5 are adapted for insertion of a ⅜ inch tool, and larger receiving means 6 are adapted for insertion of a ½ inch tool. The receiving means can be adapted to fit a variety of tools to be stored, for example, with heads of from ¼ to ¾ inch. The configuration of the receiving means can also vary widely. As shown in FIGS. 1 and 2, the receiving means are square in configuration. Alternate embodiments of the receiving means shown can be formed in a wide variety of configurations, including ovoid, elliptical, triangular, circular, and irregular organic shapes. Three representative configurations is shown in FIGS. 4A, 4B, and 4C, in which the terminal end of the male drive means is illustrated in broken lines. All embodiments of the receiving means of the present invention are adapted to mate with the male drive end of a power tool, and thus the exact dimensions and configuration will be dependent upon the tool to be stored, as will be apparent to those skilled in the art.

The female receiving means can, in their most basic embodiment, be apertures formed in the first planar surface. The receiving means preferably includes a collar or biasing surface on at least one side of the receiving means, shown in FIG. 2 as elements 10. Preferably, this is in the form of a single support and biasing bar 12, with apertures formed therein corresponding to the apertures in the surface of the first planar surface, and aligned therewith. The bar can be formed of material such as sheet metal stock. The thickness will vary with the thickness of the basic material used in the surface of the device, but will generally have a thickness of at least about 3/16 inch.

In addition to variations in the size and configuration of the female receiving means, the collar can be lined with a variety of cushioning materials. The collar or sleeve provides further support for a tool placed within the receiving means shown. In another preferred embodiment of the invention, the collar is tapered to provide a force fit of the tool when fully inserted into the receiving means.

Typically, the male driving end of such a tool comprises a 3/8 or 1/2 inch male driving end. Even for metric sockets sets, the female end of the socket that interacts with the male driving end of the power driven tool is typically adapted for use with a 3/8 or 1/2 inch male driving end. The present invention is compatible with power driven tools having any size driving end, and the embodiment shown in FIGS. 1–3 has two sizes of female receiving means.

Alternate configurations of the female receiving means of the present invention include a wide variety of shapes. For example, a female receiving means in the shape of a long rectangular slot having an upper and lower section, wherein the distance between the upper and lower sections is 3/8 or 1/2 inches, can accommodate multiple tools in the slot. An alternate embodiment of the present female receiving means is a circular aperture adapted for insertion of the square male drive end. The circle could be graduated or tapered and lined with a deformable material such as rubber to further secure the tool.

The female receiving means can be separated or elevated from an operating surface by a variety of means other than that shown in FIG. 1, including, for example, legs on the first planar surface. The receiving means is separated or elevated by a distance sufficient to provide sufficient clearance to permit insertion of the male driving end of a tool. The actual distance necessary for proper separation will vary according to the location and orientation of the female receiving means. In addition, in preferred embodiments, the distance may be modified to provide a means of storing tools at an efficient ergonomic angle.

In the preferred embodiment shown in FIGS. 1 and 2, the device comprises a first planar surface in which the female receiving means are formed, a second planar surface which acts as a base plate and is adapted to be positioned on or adjacent to a surface, the second planar surface being connected to the first at an angle of about 120°, a third planar surface connected to the first planar surface opposite the second planar surface, and a fourth planar surface connected to the third planar surface opposite the first planar surface at an angle of about 90°. The third and fourth planar surfaces comprise the means for separating the female receiving means from an operating surface. In embodiments not having such additional surfaces, the angular relationship between the first and second planar surfaces, and thus the second planar surface, is the means for separating the female receiving means. Variations and modifications of the angular relationship will be apparent to those skilled in the art, and will depend on, among other things, the size of the tool to be stored and the orientation of the device.

The device of the present invention further comprises a support and biasing bar on an inner surface of the device, the bar having apertures formed therein corresponding to the apertures formed in the surface of the device and aligned therewith.

The present invention can be used in a horizontal position, for example, resting on the surface of a tool chest. When so used, anchoring means, not shown, can be provided to secure the device to the work surface. Alternately, as shown in FIG. 7, the device can be hung on the side of a tool chest, or from a wall, using hooking means 13 at the end of the second planar surface. The device should also be configured so that, regardless of what position the device is resting in, at least one of the female receiving means is positioned to hold a tool so that the tool can be easily grasped by an individual. For example, if the device is resting in a substantially vertical position approximately 3 to 3 and 1/2 feet from the ground, the female receiving means should be oriented at an angle from about horizontal to about 45°. If the angle is larger than 45° from horizontal, the tools stored in the female receiving end of the device will be too erect and positioned too high to be easily grasped by an individual. Accordingly, the height and orientation of the device will depend on where it will be positioned. Typically, the higher the device is positioned, the smaller the angle the female receiving means will extend from horizontal. The preferred range of angles of orientation of the female receiving means is about from 90 to 120°.

The present devices provide means for retaining drive tools, often weighing over 5 pounds, in a ready-to-use position, with only the male drive end inserted into the holding device, the portion of the device posterior to the drive end being cantilevered away from the surface and available for easy pickup. The biasing and support bar retains the drive tool in a secure position, even with movement and jostling of a cart or tool chest on which the devices may be positioned.

I claim:

1. A power driven tool inserted in a holding device, the tool comprising a posterior handle and a substantially rectilinear male drive end at an anterior terminal end thereof, the male drive end being adapted to be inserted into a substantially rectilinear female end of a component to be driven or manipulated by the tool, the holding device comprising at least one substantially rectilinear aperture formed in a first surface of the device, the aperture having an internal dimension substantially equal to the maximum dimension of the male drive end and having a cross-sectional configuration for retaining the male drive end in a fixed position, while the portion of the tool posterior to the drive end is unsupported and cantilevered from the aperture, the surface in which the at least one aperture is formed being positioned at an acute angle with respect to a plane on which the device is positioned;

a support and biasing bar on an inner surface of the device, the bar having apertures formed therein corresponding to the apertures formed in the surface of the device and aligned therewith;

a second surface contiguous with the first surface;

means for separating the surface in which the at least one aperture is formed from the surface of the plane on which the device is positioned by a distance at least equal to the length of the male drive end; and means integral with the second surface for hanging the device on a substantially vertical surface.

2. A device of claim 1 wherein the surface of the device in which the at least one aperture is formed is joined to and at a fixed angular relationship with a second planar surface.

3. A device of claim 2 wherein the means for hanging comprises at least one hooking surface formed in the end of the second planar surface opposite the point of attachment to the first planar surface.

4. A device of claim 3 wherein the second planar surface is joined to the first planar surface at an angle of about from 100 to 165 degrees.

5. A device of claim 1 wherein the at least one aperture is substantially rectilinear, defined by four side walls, each side wall having a length of about ⅜ inch.

6. A device of claim 1 wherein the means for hanging comprises at least one hooking surface formed in the end of the second planar surface opposite the point of attachment to the first planar surface.

7. A device of claim 1 wherein the support bar is at least about 3/16 inch thick.

* * * * *

UNITED STATES PATENT AND TRADEMARK OFFICE

CERTIFICATE OF CORRECTION

PATENT NO. : 6,484,892 B1
DATED : November 26, 2002
INVENTOR(S) : Randolph E. Gooner It is certified that error appears in the above-identified patent and that said Letters Patent is hereby corrected as shown below:

Column 5,
Line 11, delete claim 3 and insert -- 3. A device of Claim 2 wherein the means for separating the surface in which the at least one aperture is formed is the second planar surface. --

Column 6,
Line 1, change "claim 3" to read -- claim 2 -- .

Signed and Sealed this

Twenty ninth Day of April, 2003

JAMES E. ROGAN
*Director of the United States Patent and Trademark Office*